US006646229B2

(12) United States Patent
Girlando et al.

(10) Patent No.: US 6,646,229 B2
(45) Date of Patent: Nov. 11, 2003

(54) GLOW PLUG ARRANGED FOR MEASURING THE IONIZATION CURRENT OF AN ENGINE

(75) Inventors: Simone Girlando, Modena (IT); Stefano Vignoli, Modena (IT); Sandro Goretti, Modena (IT)

(73) Assignee: Federal-Mogul Ignition Srl, Milan (IT)

( * ) Notice: Subject to any disclaimer, the term of this patent is extended or adjusted under 35 U.S.C. 154(b) by 0 days.

(21) Appl. No.: 10/092,713

(22) Filed: Mar. 7, 2002

(65) Prior Publication Data

US 2002/0130119 A1 Sep. 19, 2002

(30) Foreign Application Priority Data

Mar. 14, 2001 (EP) ..... 01830169

(51) Int. Cl.[7] ..... F23Q 7/00

(52) U.S. Cl. ..... 219/270; 123/145 A; 313/141; 313/143; 219/541; 219/544

(58) Field of Search ..... 219/270, 544, 219/541; 361/264, 265, 266; 123/145 A, 145 R, 143 C; 313/118, 141, 142, 143

(56) References Cited

U.S. PATENT DOCUMENTS 4,351,291 A * 9/1982 Mahaney ..... 123/145 A
4,476,378 A * 10/1984 Takizawa et al. ..... 219/270
4,549,071 A * 10/1985 Hatanaka et al. ..... 219/270
4,901,196 A * 2/1990 Grzybowski ..... 361/266
5,039,839 A * 8/1991 Masaka et al. ..... 219/270
5,118,921 A * 6/1992 Aota ..... 219/270
6,037,568 A * 3/2000 Hatanaka et al. ..... 219/270
6,062,185 A * 5/2000 Chiu et al. ..... 123/145 A
6,177,653 B1 1/2001 Chiu et al.
6,215,105 B1 4/2001 Simpkins et al.
6,512,204 B1 * 1/2003 Chiu et al. ..... 219/270

FOREIGN PATENT DOCUMENTS

EP 0989370 A 3/2000
GB 1244369 A 9/1971

* cited by examiner

*Primary Examiner*—Sang Y. Paik
*Assistant Examiner*—Fadi H. Dahbour
(74) *Attorney, Agent, or Firm*—Reising, Ethington, Barnes, Kisselle, P.C.

(57) ABSTRACT

A glow plug (10) for diesel engines that includes a threaded metal tubular body (12) and a metal sheath (22) carried by the tubular body. The sheath (22) has an end portion (24) projecting from the tubular body (12) and is electrically insulated from the tubular body. The glow plug (10) includes first and second electrical terminals (30,46) and a heating resistor (34) electrically connected to the first terminal (30) and to the end portion (24) of the sheath (22). The first terminal (30) has the shape of a metal rod extending through the tubular body (12) and has an end inserted inside the sheath (22). The heating resistor (34) is also set inside the sheath (22). The second terminal (46) is electrically connected to the sheath (22) and can be disposed either coaxially around the first terminal (30) or coaxially within the first terminal.

9 Claims, 2 Drawing Sheets

GLOW PLUG ARRANGED FOR MEASURING THE IONIZATION CURRENT OF AN ENGINE

TECHNICAL FIELD

The present invention relates generally to glow plugs for diesel engines and, in particular, to glow plugs that are capable of measuring the ionization current inside the engine combustion chamber.

BACKGROUND OF THE INVENTION

FIG. 3 of European published patent application number EP-A-0989370 discloses a glow plug provided with a tubular metal body and with a metal sheath electrically insulated from the tubular body. A heating resistor is housed inside the sheath and has one of its ends connected to the sheath and the other connected a first electrical terminal. The glow plug illustrated in EP-A-0989370 comprises a second terminal electrically connected to the sheath. Electrical insulation between the sheath and the tubular body is obtained by means of a pair of rings made of ceramic material and set at the opposite ends of the tubular body. The second electrical terminal consists of an electrical wire provided with an insulating coating, which is welded to the end edge of the sheath and is set inside the tubular body.

The solution described in EP-A-0989370 presents a number of drawbacks. The solution according to the prior art requires a very long sheath which reaches as far as the ceramic ring set at the end of the tubular body opposite to the end from which the sheath protrudes. The electrical wire constituting the second terminal needs to be welded in order to create the electrical connection with the internal edge of the sheath, and this weld involves problems of resistance over time and affords poor guarantees of stability of the electrical connection.

In the case of the embodiment illustrated in FIGS. 4 and 5 of EP-A-0989370 the use is envisaged of three electrical contacts, which increase the cost of the finished product. In this variant, the heating resistor is not fixed to the sheath, and there are problems of vertical alignment and centring of the heating element with respect to the sheath.

A general object of the present invention is to provide a glow plug of the type indicated above that makes it possible to overcome the drawbacks referred to previously.

SUMMARY OF THE INVENTION

According to the present invention, there is provided a glow plug for diesel engines that includes a metal tubular body and a metal sheath carried by the tubular body. The sheath has an end portion projecting from the tubular body and is electrically insulated from the tubular body. The glow plug includes first and second electrical terminals and a heating resistor electrically connected to the first terminal and to the end portion of the sheath. The first terminal has the shape of a metal rod extending through the tubular body and has an end inserted inside the sheath. The heating resistor is also set inside the sheath. The second terminal is electrically connected to the sheath and is disposed coaxially with respect to the first terminal.

BRIEF DESCRIPTION OF THE DRAWINGS

The present invention will now be described in detail with reference to the attached drawings, in which.

DETAILED DESCRIPTION OF THE PREFERRED EMBODIMENTS

Figure 1:
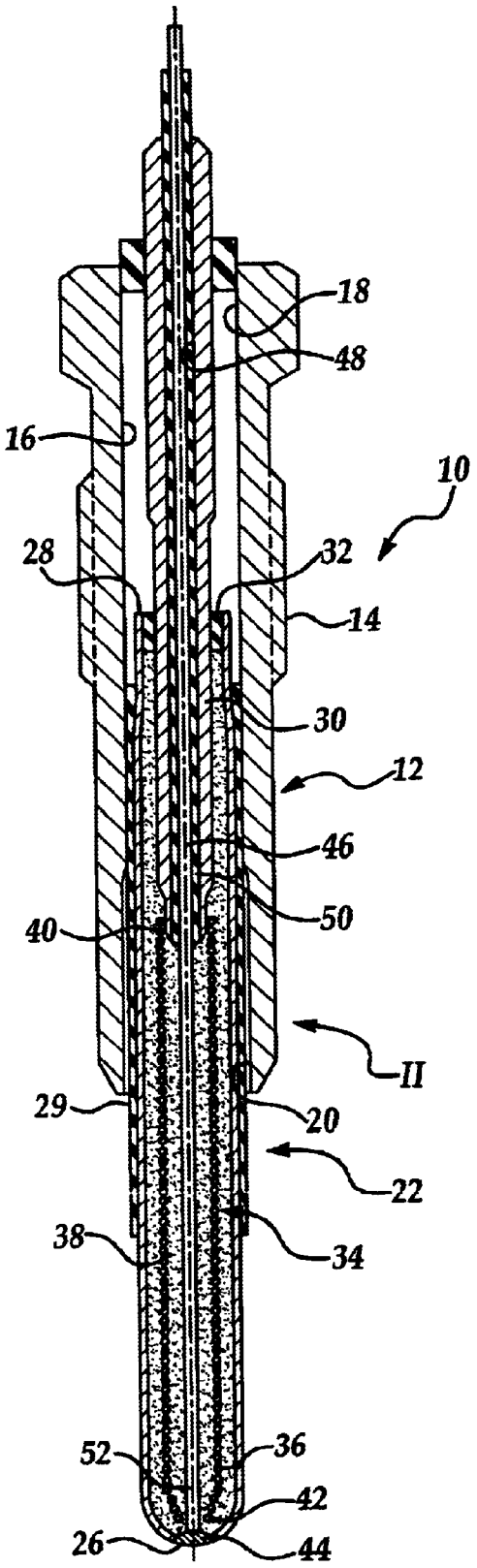
FIG. 1 is a longitudinal section of a glow plug according to a first embodiment of the present invention.
Figure 2:
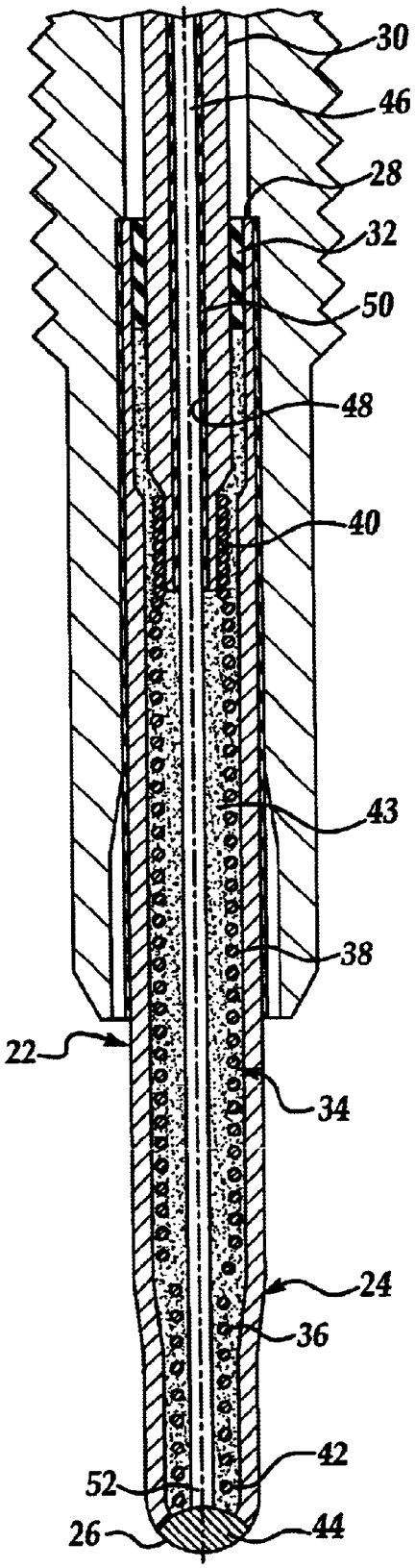
FIG. 2 is a section at a larger scale of the part indicated by the arrow II in FIG. 1.

With reference to FIGS. 1 and 2, the number 10 designates a glow plug for diesel engines. The glow plug 10 comprises a metal tubular body 12 having a threaded portion 14 designed to engage a threaded hole (not illustrated) provided in the cylinder head of a diesel engine. The tubular body 12 has a through cavity 16, which has a first end 18 and a second end 20.

The plug 10 includes a metal sheath 22 having a projecting portion 24 that extends beyond the end 20 of the tubular body 12. The projecting portion 24 is designed to be inserted into the combustion chamber of an engine and constitutes the incandescent part of the plug 10. The sheath 22 has a first end 26, which is closed and has a rounded shape, and a second end 28. The metal sheath 22 is driven inside the cavity 16 of the tubular body 12. The outer surface of the sheath 22, in the portion that extends inside the cavity 16, is coated with a layer 29 of electrically insulating material, preferably applied by means of plasma deposition. This layer 19 of insulating material has the purpose of insulating the sheath 22 with respect to the ground potential represented by the cylinder head of the engine, to which the body 22 is electrically connected.

Again with reference to FIGS. 1 and 2, a first electrical terminal 30 having the shape of an elongated cylindrical bar, or rod, extends through the end 28 of the sheath 22. An insulating ring 32 is set between the end portion 28 of the sheath 22 and the outer surface of the first terminal 30. Housed inside the sheath 22 is an electrical heating resistor 34 made up of one or more coils of conductive wire. In the example illustrated in the figures, the heating resistor 34 is constituted, in a way of itself known, by a heating coil 36 and a regulating coil 38 welded together. One first end 40 of the heating resistor 34 is electrically connected to the first terminal 30, and a second end 42 of the heating resistor 34 is electrically connected to the end 26 of the sheath 22. This electrical connection is obtained by means of a weld designated by 44 in FIG. 2. In a known way, the heating resistor 34 is surrounded by a mass of insulating powder 43 which electrically insulates the heating resistor 34 from the inner wall of the sheath 22 in the portion located between the ends 40 and 42.

The plug 10 also includes a second electrical terminal 46 insulated from the first electrical terminal 30 and electrically connected to the sheath 22. In the embodiment illustrated in FIGS. 1 and 2, the second electrical terminal 46 consists of a rectilinear metal wire set coaxially to the cylindrical bar that constitutes the first electrical terminal 30. The rectilinear wire 46 extends through a through hole 48 formed inside the first terminal 30. An insulating tubular element 50 is set between the outer wall of the wire 46 and the inner wall of the hole 48, to insulate the terminals 46 and 30 electrically from one another. The rectilinear wire 46 extends inside the coiled resistor 34 as far as the end 26 of the sheath 22. One end 52 of the rectilinear wire 46 is welded to the sheath 22 by means of the weld 44 itself that electrically connects the heating resistor 34 to the sheath 22.

The plug described previously can work as a glow plug for heating the engine before cold-starting and as a sensor of the ionization current inside the combustion chamber during normal engine operation. Operation as a heating glow plug is obtained by connecting the first terminal 30 to the positive potential of the battery (+12 V) and the second terminal 46 to ground, or vice versa. In this way, a heating current traverses the first terminal 30, the heating resistor 34, and closes to ground via the second terminal 46. In this case, the plug operates as a normal heating glow plug, with the only difference represented by the fact that the current returns to ground via the second terminal 46 instead of via the sheath, which, in most traditional devices, is electrically connected to ground via the tubular body 12.

In order to obtain the operating mode of an ionization-current sensor, the first terminal 30 is connected to an open contact, whilst the second terminal 46 is connected to a pre-set positive potential. In this way, no current circulates through the heating resistor 34, whilst the sheath 22 goes to a positive reference potential with respect to ground. In this second operating mode, the portion of the plug that extends inside the combustion chamber is able to attract the negative electric charges thanks to the fact that it is at a positive potential. Through the second terminal 46 it is possible to receive an electrical signal indicating the ionization current present in the combustion chamber, which enables a diagnosis to be made of the operating conditions of the engine.

Figure 3:
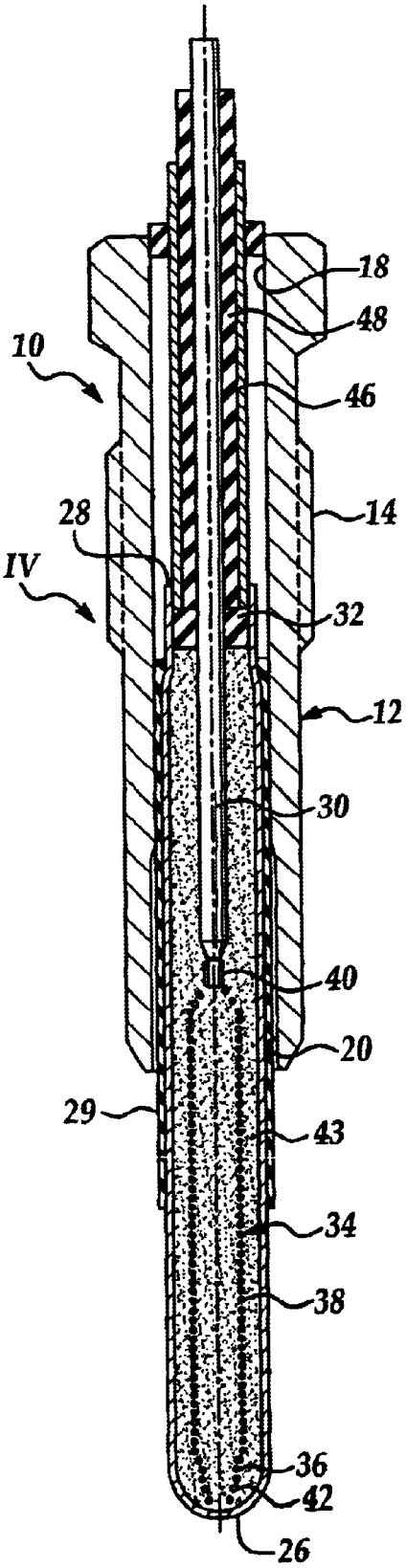
FIG. 3 is a longitudinal section illustrating a second embodiment of the glow plug according to the invention.
Figure 4:
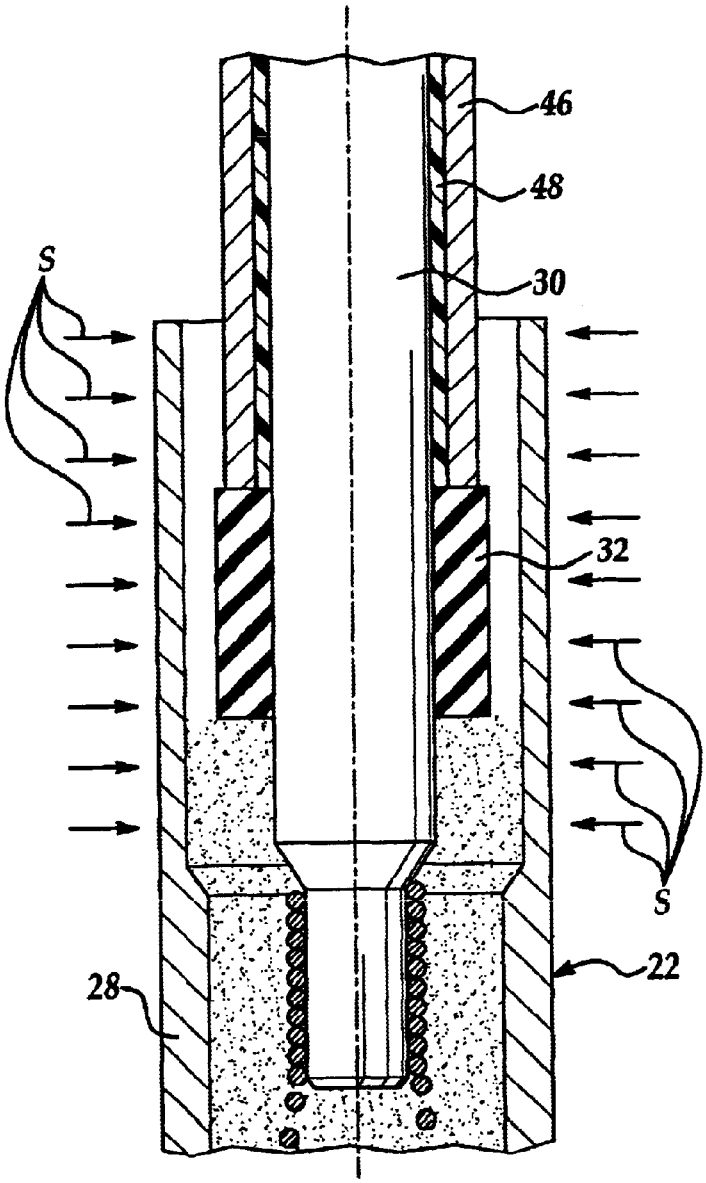
FIG. 4 is a section at a larger scale of the part indicated by the arrow IV in FIG. 3.

In the second embodiment illustrated in FIGS. 3 and 4, the items corresponding to those previously described are designated by the same reference numbers. The main difference with respect to the embodiment previously described lies in the different shape of the second terminal 46, which in this case consists of a tubular element set coaxially to the first terminal 30 outside the latter. The second terminal 46 is electrically insulated from the first terminal 30 by means of an insulating tubular element 48 set between the outer surface of the first terminal 30 and the inner surface of the second terminal 46. With reference to FIG. 4, after the first terminal 30, the second terminal 46, and the heating resistor 34 have been positioned inside the sheath 22, the sheath 22 undergoes a plastic deformation of radial compression from outside by hammering, as represented by the arrows S. This plastic deformation brings the inner wall of the end portion 28 of the sheath 22 into contact with the outer surface of the corresponding end portion of the second terminal 46, thus establishing an electrical connection between the sheath 22 and the second terminal 46.

What is claimed is:

1. A glow plug for diesel engines, comprising:

a metal tubular body;

a metal sheath carried by the tubular body and having an end portion projecting from the tubular body, in which the metal sheath is electrically insulated from the tubular body;

a first electrical terminal having the shape of a metal rod extending through the tubular body and having an end inserted inside the aforesaid sheath;

a heating resistor set inside the aforesaid sheath, the heating resistor being electrically connected to the first terminal and to the aforesaid end portion of the sheath; and a second electrical terminal electrically connected to the sheath and disposed coaxially with respect to the first electrical terminal.

2. A glow plug according to claim 1, characterized in that the tubular body includes a means for fixing the tubular body to the cylinder head of an engine.

3. A glow plug according to claim 2, characterized in that the means for fixing the tubular body to the cylinder head of an engine comprises a threaded portion of the tubular body.

4. A glow plug for diesel engines, comprising:

a metal tubular body;

a metal sheath carried by the tubular body and having an end portion projecting from the tubular body, in which the metal sheath is electrically insulated from the tubular body;

a first electrical terminal having the shape of a metal rod extending through the tubular body and having an end inserted inside the aforesaid sheath;

a heating resistor set inside the aforesaid sheath, the heating resistor being electrically connected to the first terminal and to the aforesaid end portion of the sheath;

a second electrical terminal electrically connected to the sheath and disposed coaxially with respect to the first electrical terminal; and an insulating tubular element set coaxially between the first terminal and the second electrical terminal.

5. A glow plug for diesel engines, comprising:

a metal tubular body;

a metal sheath carried by the tubular body and having an end portion projecting from the tubular body, in which the metal sheath is electrically insulated from the tubular body;

a first electrical terminal having the shape of a metal rod extending through the tubular body and having an end inserted inside the aforesaid sheath;

a heating resistor set inside the aforesaid sheath, the heating resistor being electrically connected to the first terminal and to the aforesaid end portion of the sheath; and a second electrical terminal electrically connected to the sheath and disposed coaxially with respect to the first electrical terminal, characterized in that the second electrical terminal extends into a through hole formed inside the first terminal.

6. A glow plug according to claim 5, characterized in that the second electrical terminal extends inside the heating resistor up to an end of the sheath.

7. A glow plug according to claim 6, characterized in that one end of the second terminal and one end of the heating resistor are electrically connected to the sheath by one and the same weld.

8. A glow plug for diesel engines, comprising:

a metal tubular body;

a metal sheath carried by the tubular body and having an end portion projecting from the tubular body, in which the metal sheath is electrically insulated from the tubular body;

a first electrical terminal having the shape of a metal rod extending through the tubular body and having an end inserted inside the aforesaid sheath;

a heating resistor set inside the aforesaid sheath, the heating resistor being electrically connected to the first terminal and to the aforesaid end portion of the sheath; and a second electrical terminal electrically connected to the sheath and disposed coaxially with respect to the first electrical terminal, characterized in that the second terminal comprises a tubular element set coaxially to the outside of the first terminal.

9. A glow plug according to claim 8, characterized in that one end portion of the sheath is compressed against a corresponding end portion of the second terminal to establish an electrical connection between the sheath and the second terminal.

* * * * *